US006469608B2

(12) United States Patent
Shimoide et al.

(10) Patent No.: US 6,469,608 B2
(45) Date of Patent: Oct. 22, 2002

(54) STICK-TYPE IGNITION COIL DEVICE HAVING THERMAL STRESS RELEASING MEMBER

(75) Inventors: Yoshihiro Shimoide, Chita-gun (JP); Toshiyuki Shinozawa, Tsurugashima (JP); Shuichi Matsubayashi, Kawaguchi (JP)

(73) Assignees: Denso Corporation (JP); Toyo Denso Kabushiki Kaisha (JP)

( * ) Notice: Subject to any disclaimer, the term of this patent is extended or adjusted under 35 U.S.C. 154(b) by 0 days.

(21) Appl. No.: 09/745,184

(22) Filed: Dec. 22, 2000

(65) Prior Publication Data

US 2002/0011910 A1 Jan. 31, 2002

(30) Foreign Application Priority Data

Dec. 24, 1999 (JP) ..... 11-366445

(51) Int. Cl.[7] ..... H01F 27/02
(52) U.S. Cl. ..... 336/90; 536/96; 536/192
(58) Field of Search ..... 336/90, 92, 96, 336/107, 192, 110; 123/634, 635

(56) References Cited

U.S. PATENT DOCUMENTS 5,870,012 A * 2/1999 Sakamaki et al. ..... 336/107

FOREIGN PATENT DOCUMENTS

JP 9-35960 2/1997

* cited by examiner

*Primary Examiner*—Elvin Enad
*Assistant Examiner*—Tuyen T. Nguyen
(74) *Attorney, Agent, or Firm*—Nixon & Vanderhye PC

(57) ABSTRACT

A stick-type ignition coil device has a central core, and primary and secondary windings wound concentrically around the central core in a coil casing. A positioning part is provided in the casing to define the position of the central core. An insulating resin such as epoxy resin is filled in the coil casing for electrical insulation and fixing of components in the coil casing. A thermal stress releasing member, which is less adhesive to and easily peelable from the insulating resin, is provided on the upper surface of the positioning part. The thermal stress releasing member is separated from the insulating resin and allows the positioning member to move with the central core, thereby minimizing cracks which will occur in the insulating resin formed between the central core and the positioning part.

19 Claims, 3 Drawing Sheets

STICK-TYPE IGNITION COIL DEVICE HAVING THERMAL STRESS RELEASING MEMBER

CROSS REFERENCE TO RELATED APPLICATION

This application is based on and incorporates herein by reference Japanese Patent Application No. 11-366445 filed Dec. 24, 1999.

BACKGROUND OF THE INVENTION

The present invention relates to a stick-type ignition coil device that is fit in a plug hole of each cylinder of an engine.

A stick-type ignition coil device that is fit in a plug hole of each cylinder of an internal combustion engine is constructed as shown in FIG. 3. Specifically, the ignition coil device is generally constructed with cylindrical coil casing 11, a central core 18, a primary spool 19, a primary winding 20 wound about the primary spool 19, a secondary spool 21 and a secondary winding 22 wound about the secondary spool 21. These components are disposed concentrically. A connector housing 14 is formed with a positioning part 16 and assembled with the coil casing 11 in such a manner that the positioning part 16 holds the central core 18 in central position through a cushion 23. The coil casing 11, the connector housing 14 and the spools 19, 21 are made of resin. An insulating resin 24 is filled in spaces among those components for electrical insulation and fixing.

The ignition coil device repeats to generate heat in high voltage generating operation and radiate heat after the operation. As a result, the insulating resin 24, the positioning part 16 and the like repeat thermal expansion and contraction. As the positioning part 16 and the insulating resin 24 have different coefficients of thermal expansion, thermal stress exerts from the insulating resin 24 to the positioning part 16 due to temperature changes. The central core 18 and the cushion 23 displace in the downward direction in FIG. 3 relative to the positioning part 16 due to difference between the coefficients of thermal expansion, when the temperature rises in the ignition coil operation.

As the positioning part 16 is firmly fixed to the insulating resin 24, the positioning part 16 is restricted from displacing by the insulating resin 24 covering the upper surface of the positioning part 16 and the positioning part 16 does not deform. As a result, the insulating resin layer 24*a* is subjected to pull stress in the upward and downward directions thus causing cracks X in the insulating resin layer 24*a* between the positioning part 16 and the cushion 23 as shown in FIG. 4. If the cracks X progress in the longitudinal direction along the central core 18, the electrical insulation between the central core 18 and the secondary winding 22 which generates a high ignition voltage is lessened due to dielectric breakdown Y across the spool 21.

SUMMARY OF THE INVENTION

It is therefore an object of the present invention to provide a stick-type ignition coil device, which reduces generation of cracks and ensures electrical insulation.

According to the present invention, a stick-type ignition coil device for engines comprises a central core, primary and secondary windings, a positioning member disposed to define a position of the central core, a coil casing encasing these components therein, and an insulating resin filled in spaces in the coil casing. A thermal stress releasing member is disposed on the upper surface of the positioning member to release thermal stress which exerts between the positioning member and the insulating resin covering the positioning member.

Preferably, the thermal stress releasing member is made of a material which is less adhesive to the insulating resin and the positioning member. The thermal stress releasing member is larger than an end surface of the central core in size and provided right above the central core.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
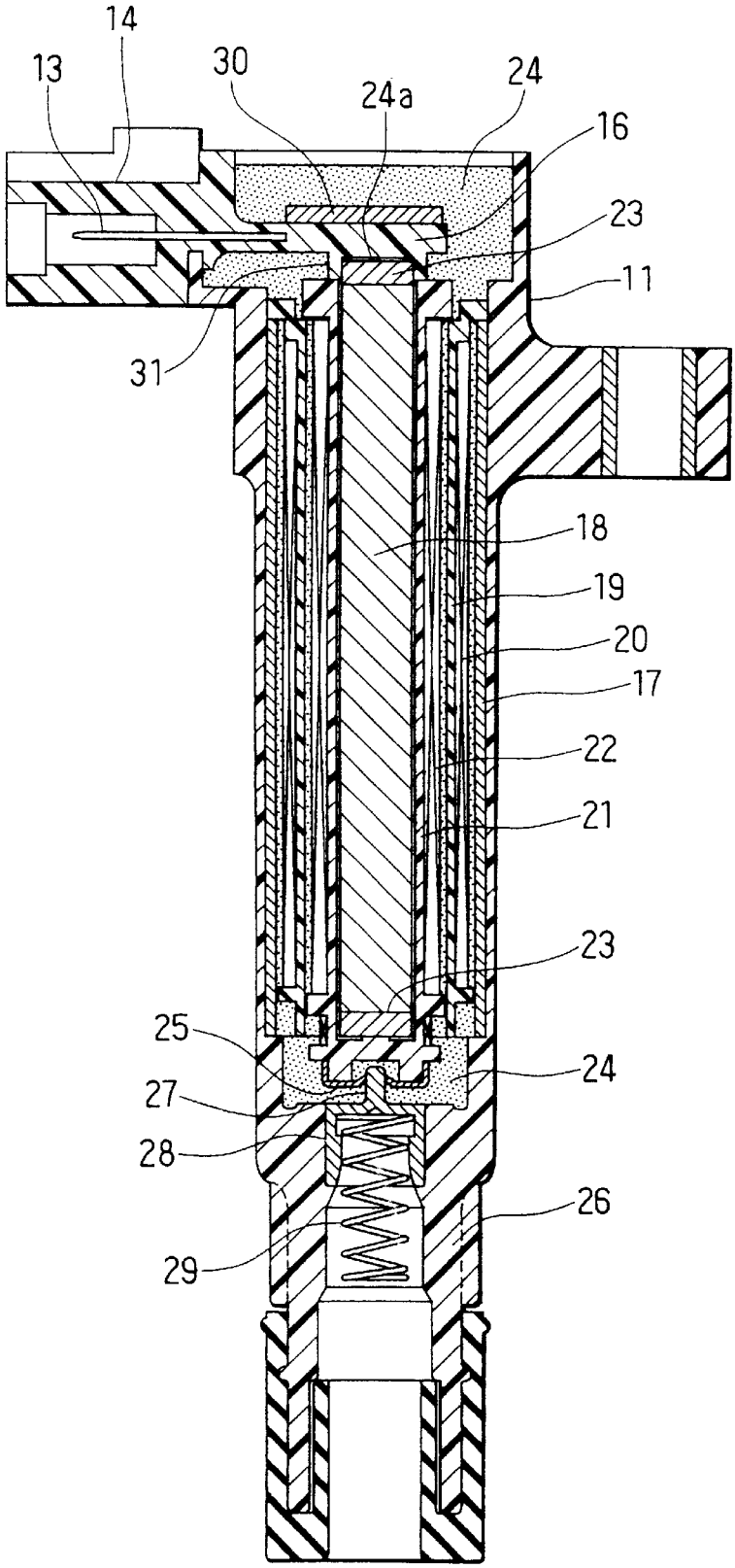
FIG. 1 is a sectional view of an ignition coil device according to an embodiment of the present invention.

Referring first to FIG. 1, a stick-type ignition coil device has a cylindrical coil casing 11 made of an insulating resin, and a connector housing 14 insert-molded with connector pins 13 is assembled to the upper side of the coil casing 11 by, for instance, press-fitting. The coil casing 11 encases therein a rod-shaped central core 18 and a cylindrical outer core 17 concentrically at its innermost part and its outermost part, respectively. A cylindrical primary spool 19 made of resin and a primary winding 20 wound about the primary spool 19 are disposed inside the outer core 17. A cylindrical bottomed secondary spool 21 made of resin and a secondary winding 22 wound about the secondary spool 19 are disposed between the central core 18 and the primary spool 19.

A pair of cushions 23 are disposed at the uppermost end and the lowermost end of the central core 18 to restrict excessive stress from exerting on the central core 18 in the longitudinal or axial direction. Each cushion 23 is made of a heat-resistive elastic material such as sponge, elastomer or the like. This elastic material should preferably be a magnetic distortion restricting-type. An electrically conductive terminal plate 25 is disposed at the lowermost position of the secondary spool 21 and connected to the secondary winding 22.

The coil casing 11 is integrally formed with a high voltage tower 26 at its lowermost side. An electrically-conductive terminal cup 28 having a high voltage terminal 27 is insert-molded with or press-fit in the high voltage tower 26. The high voltage terminal 27 is held in pressed-contact with the terminal plate 25 so that a high voltage generated by the secondary winding 22 is applied to a spark plug (not shown) through an electrically-conductive spring 29.

The connector housing 14 is integrally formed with a positioning part 16, which has an annular protrusion 31 to define the position of the central core 18. The annular protrusion 31 is formed on the lower surface of the positioning part 16. When the connector housing 14 is assembled to the coil casing 11, the positioning part 16 holds the central core 18 and the cushions 23 in the central position in the coil casing 11 in such a manner that the annular protrusion 31 surrounds the cushion 23.

A thermal stress releasing member 30 is mounted on the upper side surface of the positioning part 16. A thermosetting resin such as epoxy resin is vacuum-filled as an insulating resin 24 in the spaces among the above components in the coil casing 11 and the connector housing 14 thereby to fix the components in position and electrically insulates the components from each other.

The thermal stress releasing member 30 is made of a material such as silicone, polypropylene (PP), polyphenylene sulfide (PPS) or the like which is less adhesive to the insulating resin (epoxy resin) 24 and the positioning part (16) than the insulating resin (24) is to the positioning part 16. Thus, the thermal stress releasing member 30 is easily peelable from the insulating resin (epoxy resin) 24 or the positioning part 16.

As the thermal stress releasing member 30, silicone may be shaped into an adhesive tape and adhered to the upper side of the positioning part 16. Silicone may alternatively pasted or coated on the upper side of the positioning part 16. Polypropylene (PP) or polyphenylene sulfide (PPS) may be molded into a disk plate and attached to the upper surface of the positioning part 16 by an adhesive. The thermal stress releasing member 30 is sized larger than the upper surface of the central core 18 and is positioned right above the central core 18.

Figure 2:
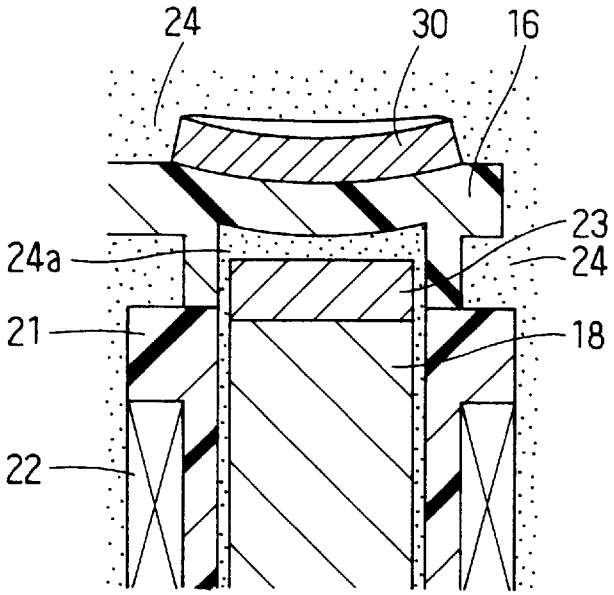
FIG. 2 is an enlarged sectional view of a part of the ignition coil shown in FIG. 1.
Figure 4:
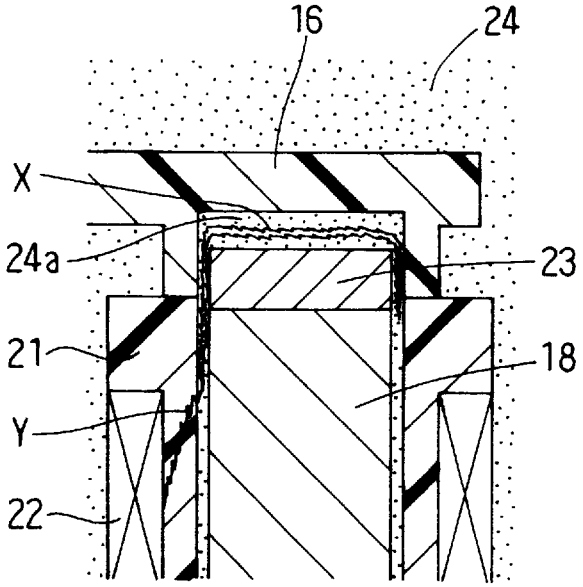
FIG. 4 RELATED ART
FIG. 4 is an enlarged sectional view of a part of the ignition coil shown in FIG. 3.
Figure 3:
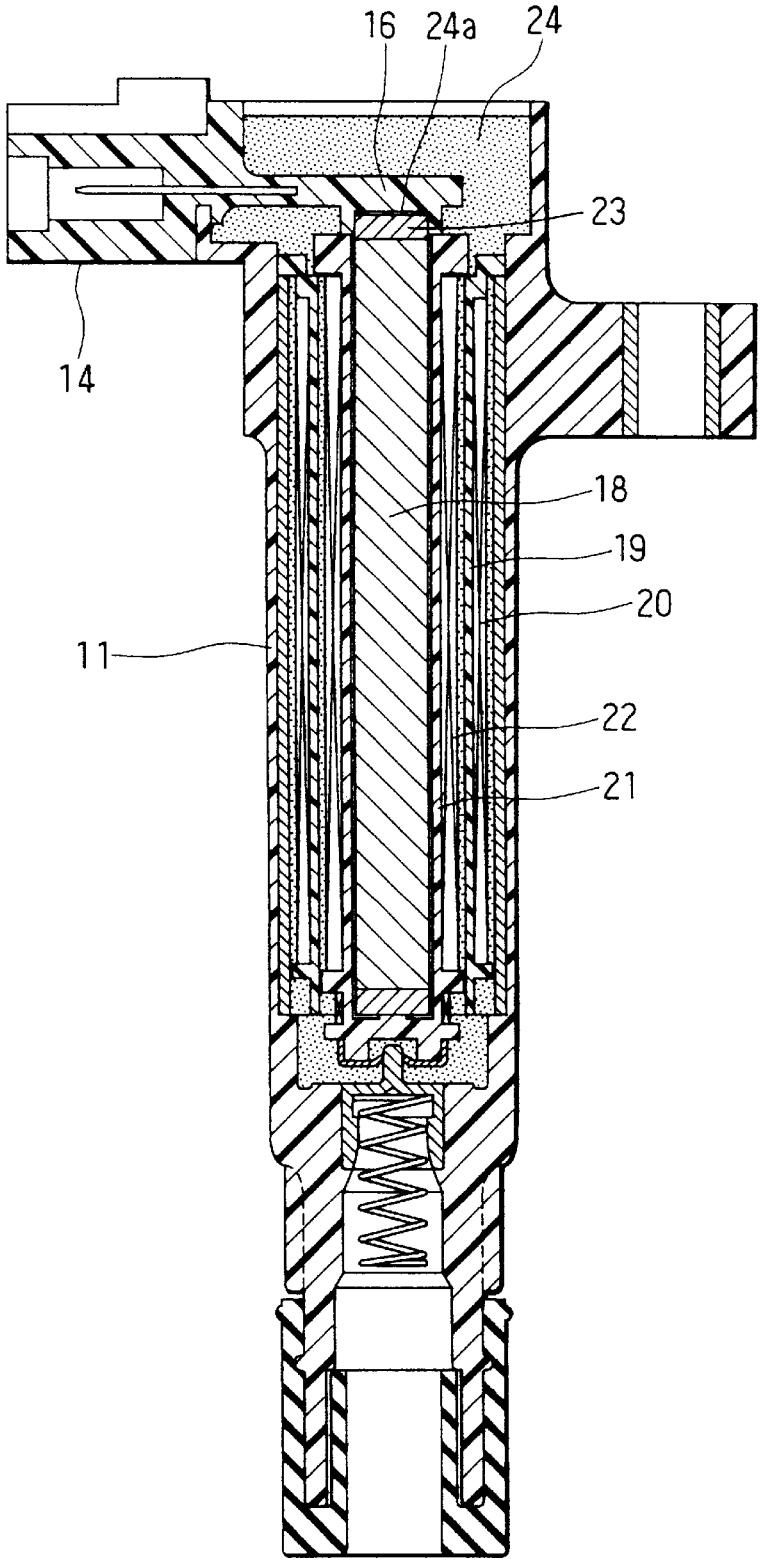
FIG. 3 RELATED ART
FIG. 3 is a sectional view of an ignition coil device according to a related art.

In this embodiment, the central core 18 and the cushion 23 displace in the downward direction in FIGS. 1 and 2 relative to the positioning part 16 due to difference between the coefficients of thermal expansion of the components, when the temperature rises in the high voltage generating operation, that is, in the engine operation. In this instance, the central core 18 and the cushion 23 tend to pull down the positioning part 16 through the insulating resin layer 24*a*.

As the thermal stress releasing member 30 is easily peelable or separable from the insulating resin 24 covering the thermal stress releasing member 30, the positioning member 16 above the central core 18 is released from a constraint of the insulating resin 24 in the axial direction and allowed to deform in the downward direction as shown in FIG. 2. Thus, the insulating layer 24*a* formed between the positioning part 16 and the cushion 23 is not subjected to the pull force in the axially opposite (upward and downward) directions. As a result, generation of cracks in the insulating resin layer 24*a* is minimized and the electrical insulation of the components is ensured.

As the thermal stress releasing member 30 is positioned right above the central core 18 and larger than the upper surface of the central core 18, the thermal stress which exerts from the positioning part 16 to the insulating resin layer 24*a* which is right above the central core 18 is sufficiently minimized to restrict generation of cracks in the insulating resin layer 24*a*.

The present invention should not be limited to the above embodiment, but may be implemented in many other ways. For instance, the thermal stress releasing member 30 may be slightly displaced in the lateral direction from the radial center of the central core 18. The thermal stress releasing member 30 may have a central hole in the center thereof. The thermal stress releasing member 30 may be made of a rubber which is easily deformable. The positioning part 16 may be formed separately from the connector housing 14.

What is claimed is:

1. A stick-type ignition coil device for engines comprising:

a cylindrical coil casing;

a central core shaped in a rod and disposed in a radial center of the coil casing;

primary and secondary windings disposed concentrically around the central core in the coil casing;

positioning member having upper and lower surfaces and disposed above the central core to define a position of the central core at a side of the lower surface thereof;

an insulating resin filled in spaces in the coil casing for electrical insulation among components; and a thermal stress releasing member disposed on the upper surface of the positioning member and covered with the insulating resin, the thermal stress releasing member being for releasing thermal stress between the positioning member and the insulating resin covering the positioning member, wherein the thermal stress releasing member is made of a material which is less adherent to the insulating resin and to the positioning member than the insulating resin is adherent to the positioning member.

2. The stick-type ignition coil device as in claim 1, wherein the thermal stress releasing member is larger than an end surface of the central core in size and provided vertically above the central core.

3. The stick-type ignition coil device as in claim 1, further comprising:

a connector housing integrally formed with the positioning member and assembled to the coil casing.

4. The stick-type ignition coil device as in claim 1, wherein the positioning member covers an upper end surface of the central core and the insulating resin is also filled in a space defined between the positioning member and the central core to define an insulating resin layer therebetween.

5. The stick-type ignition coil device as in claim 1, wherein the thermal stress releasing member is disposed solely on the upper surface of the positioning member.

6. The stick-type ignition coil device as in claim 1, wherein the positioning member is integrally formed with a connector housing fixed to the coil casing.

7. The stick-type ignition coil device as in claim 1, wherein a space is defined between the positioning member and the central core and the insulating resin is filled in said space to define an insulating resin layer therebetween.

8. The stick-type ignition coil device as in claim 7, further comprising a cushion member disposed in said space between the central core and the insulating resin layer.

9. The stick-type ignition coil device as in claim 1, wherein the thermal stress releasing member is made of a material selective from the group consisting of silicone, polypropylene, polyphenylene-sulfide.

10. The stick-type ignition coil device as in claim 1, wherein the thermal stress releasing member is adhesively secured to the upper surface of the positioning member.

11. The stick-type ignition coil device as in claim 10, wherein the thermal stress releasing member is shaped as a disk plate.

12. A stick-type ignition coil device for engines comprising:

a cylindrical coil casing:

a rod-shaped central core disposed coaxial to a radial center axis of the coil casing;

primary and secondary windings disposed concentrically around the central core in the coil casing;

a positioning member having upper and lower surfaces and disposed above the central core to cover an upper end surface of the central core and define a position of the central core at a side of the lower surface thereof;

an insulating resin filled in spaces in the coil casing to cover the positioning member and to form an insulating resin layer between the positioning member and the central core;

a thermal stress releasing member disposed in contact with the surface of the positioning member and covered with the insulating resin, the thermal stress releasing member being disposed for releasing thermal stress between the positioning member and the insulating resin covering the same.

13. The stick-type ignition coil device as in claim 12, wherein the thermal stress releasing member is disposed solely on the upper surface of the positioning member.

14. The stick-type ignition coil device as in claim 12, wherein the thermal stress releasing member is made of a material which is less adherent to the insulating resin and to the positioning member than the insulating resin is adherent to the positioning member.

15. The stick-type ignition coil device as in claim 14, wherein the thermal stress releasing member is made of a material selective from the group consisting of silicone, polypropylene, polyphenylene-sulfide.

16. The stick-type ignition coil device as in claim 12, wherein the thermal stress releasing member is adhesively secured to the upper surface of the positioning member.

17. The stick-type ignition coil device as in claim 16, wherein the thermal stress releasing member is shaped as a disk plate.

18. The stick-type ignition coil device as in claim 12, wherein the thermal stress releasing member is larger than the upper end surface of the central core in size and provided above the central core.

19. The stick-type ignition coil device as in claim 12, further comprising a cushion member provided between the central core and the insulating resin layer.

* * * * *